US006338595B1

(12) United States Patent
Schollen

(10) Patent No.: US 6,338,595 B1
(45) Date of Patent: Jan. 15, 2002

(54) STORM WATER CONTROL HEADER FOR CULVERTS

(76) Inventor: Adrian T. Schollen, 54 Celebrity Greens Way, Markham Ontario (CA), L6E-1B5

( * ) Notice: Subject to any disclaimer, the term of this patent is extended or adjusted under 35 U.S.C. 154(b) by 0 days.

(21) Appl. No.: 09/605,041

(22) Filed: Jun. 29, 2000

(51) Int. Cl.[7] ..... E02B 5/08

(52) U.S. Cl. ..... 405/125; 405/40; 405/124; 405/127; 210/163; 210/170; 210/161

(58) Field of Search ..... 249/12, 11, 10; 405/40, 42, 44, 47, 87, 114, 124, 125, 127; 404/4, 5; 210/170, 162, 163

(56) References Cited

U.S. PATENT DOCUMENTS 894,339 A * 7/1908 Niemeier ..... 405/127
1,245,903 A * 11/1917 Gross ..... 210/163
2,636,352 A * 4/1953 Alger ..... 405/125
3,587,239 A * 6/1971 Feland ..... 405/125
5,032,264 A * 7/1991 Geiger ..... 210/163
5,037,542 A * 8/1991 Carroll ..... 210/161
5,672,028 A * 9/1997 Mehta ..... 405/36
6,082,925 A * 7/2000 Raasch ..... 404/2

* cited by examiner

*Primary Examiner*—David Bagnell
*Assistant Examiner*—Katherine Mitchell
(74) *Attorney, Agent, or Firm*—Harold C. Baker

(57) ABSTRACT

A storm-water control header for a culvert has a vertical head-wall with a thimble on the downstream side, and an adjustable inlet control device including a weir on the upstream side. The thimble is positioned within the culvert, and passes water from the weir to the culvert. A low flow section at the inlet control device allows water to pass from the bottom of the device at a low controlled rate to the culvert. A cover on the top of the control device excludes floating matter from the culvert.

6 Claims, 5 Drawing Sheets

STORM WATER CONTROL HEADER FOR CULVERTS

FIELD OF THE INVENTION

The present invention relates to a header intended for installation into culverts, water conduits, and watercourses for the purpose of restricting and controlling the flow of storm water in ditches, swales and other watercourses.

BACKGROUND OF THE INVENTION

During rainstorm events, and as a result of snow-melt, runoff water is directed into swales ditches and other conduits including storm sewers, and conducted in a largely uncontrolled manner to watercourses, lakes and rivers. In severe storms this can result large volumes of water moving at high velocities which can, in many instances, erode watercourses, and river banks, and damage culverts, roads and driveways, as well as carry contaminants from the watershed with deleterious results to the environment.

In undeveloped areas, interception and infiltration often retains much of the initial rainfall, but in developed areas, where the surface is largely impervious, or in situations where the ground has reached maximum saturation, or is frozen, the rapid rate of runoff can have extreme results, degrading water quality and damaging sewer infrastructure.

A system or device which will capture and detain high volumes of initial runoff for later release at a controlled rate into the drainage system, will delay and reduce water flow volume and velocity, protecting the infrastructure and the natural watercourses from physical and ecological damage.

The present invention provides for this control in a simple and effective manner, and functions without moving parts and little if any maintenance requirement.

SUMMARY OF THE INVENTION

In accordance with the present invention, a control header for culverts comprises a head-wall having an opening on the downstream face which is sized to match the diameter of the culvert, attached wing-walls, extending away from the head-wall on opposite sides thereof, and an adjustable inlet control device for regulating the flow through the opening into the culvert. Preferably the wing-walls are hinged to the head-wall, permitting the header to adapt to a variety of applications.

The above structure prevents erosion and damage to culverts and driveways overhead, and adjacent to the ditch or swale served by the culvert, as well as downstream watercourses of all types. The adjustable inlet is provided with screening means to facilitate the removal of trash and floatable solids by limiting their passage through drainage systems and into watercourses. Moderation of the velocity and volume of water flowing in the ditch reduces erosion in receiving watercourses thereby reducing erosion and undermining of banks. First flush water is detained which allows precipitation of suspended solids and improved water quality. Extended detention of storm-water aids in groundwater recharge and augmenting downstream base flow. Erosion and heaving of road and driveway crossings is achieved by controlling piping and saturation of bedding materials. Safety of individuals and animals is enhanced by providing means for their escape or removal at each header location. The esthetic appearance of an integrated head-wall and wing-wall assembly creates a clean image.

When used in a linked system, with applicant's headers installed in series at multiple culvert locations, the combined upstream storage capacity can provide both water quality and quantity benefits and minimize requirements for "end of pipe" pond facilities that are expensive and generally require the use of otherwise utilizable land.

In accordance with the present invention, the header can be manufactured from non-corrosive plastic or ferrous materials, and is compact in form to facilitate low cost packaging and shipping. Designed for assembly in the field, flexibility is provided since the header can be easily adjusted to suit a variety of installation requirements, various construction materials and situations. By means of knock outs the "low flow rate of the header can be adjusted to detain large volumes of rainwater, providing slow release into the system at a controlled rate.

The header includes an overflow weir which provides for the exact and specific control of the water levels retained at each culvert location, while allowing for passage of large volumes of water once the upstream storage area has reached maximum volume, or in extreme runoff events.

The header is so designed that a single stock-keeping unit can be used for and installed in a multiplicity of culvert sizes, thus simplifying inventory control and reducing inventory units and management.

DETAILED DESCRIPTION OF THE PREFERRED EMBODIMENTS

Figure 1:
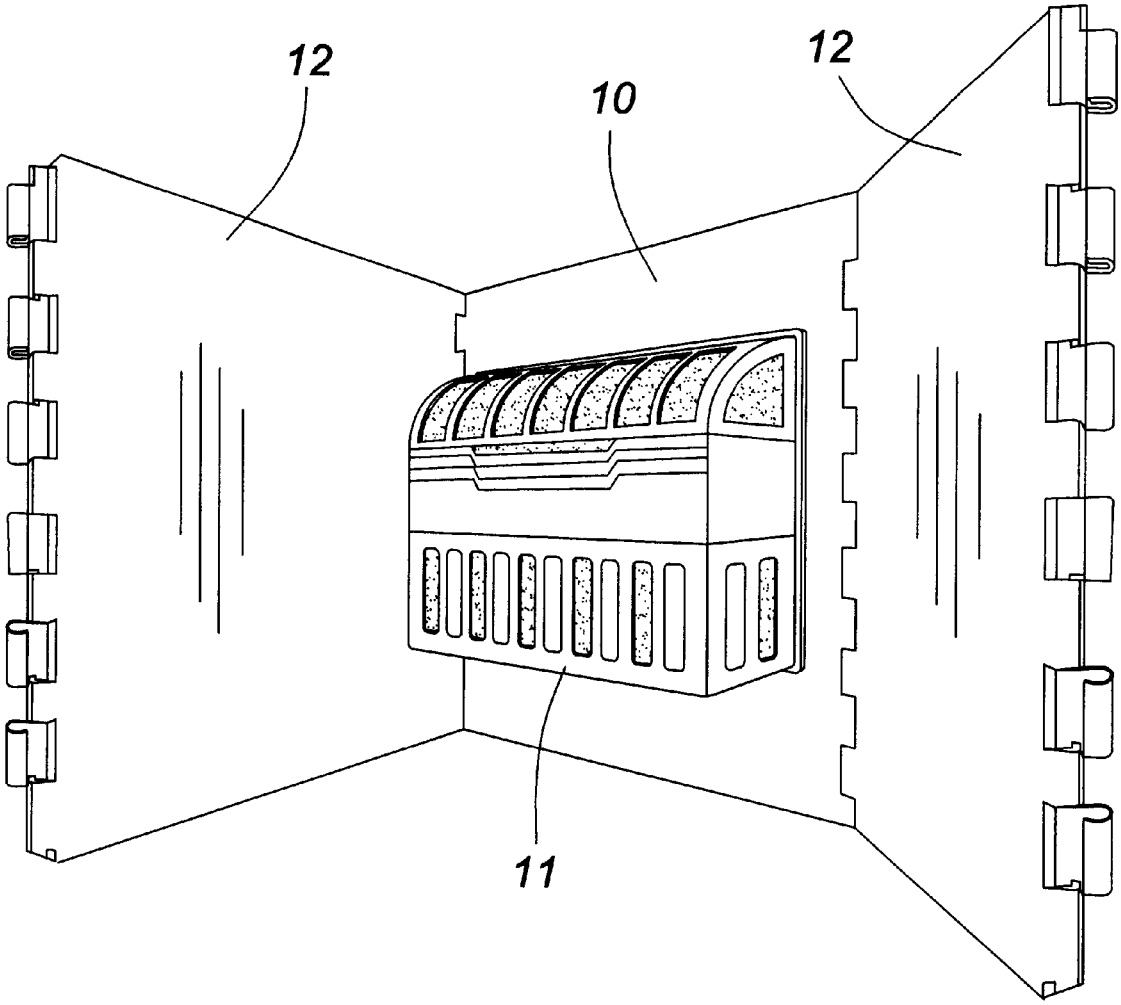
FIG. 1 is a perspective of the header of the present invention.

Referring to FIG. 1 there is shown a culvert or conduit header of the present invention consisting of a head-wall 10 in the form of a flat plate, with an adjustable inlet control device 11 mounted on the upstream face and a thimble 13 (FIG. 6) on the downstream face thereof. Detachable wing-walls 12 are shown mounted on either side of the head-wall 10.

Figure 2:
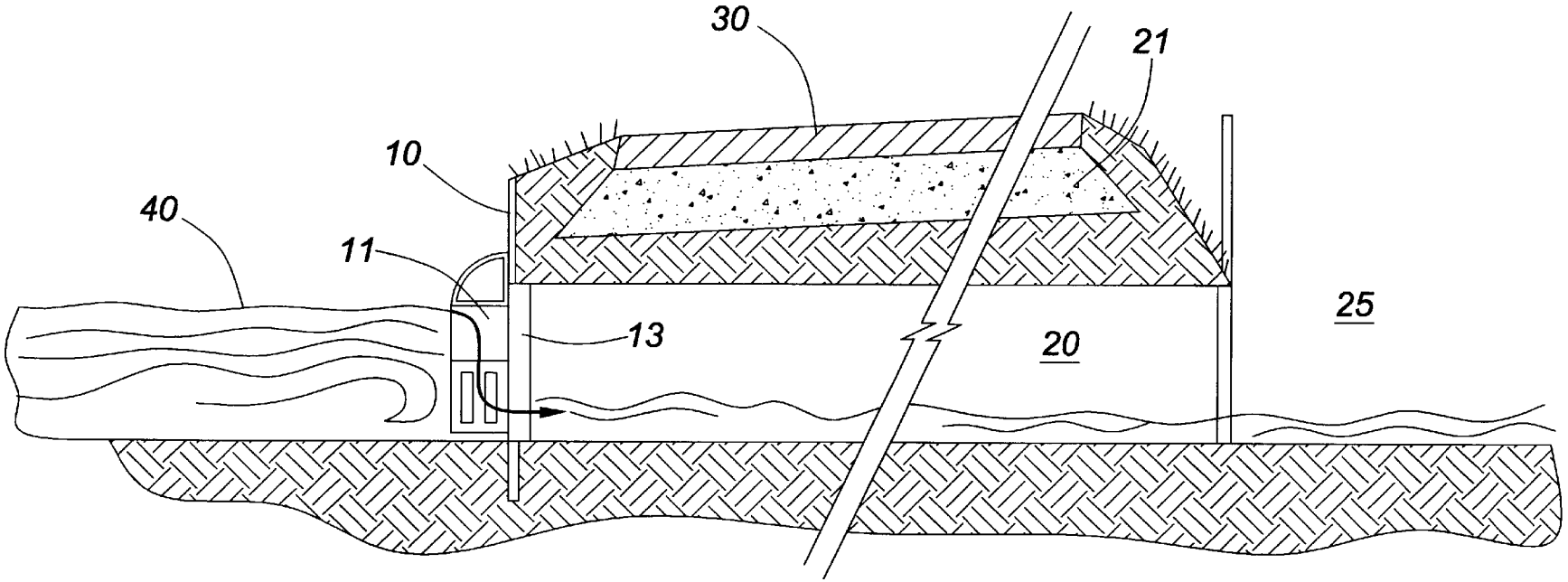
FIG. 2 is a section of a ditch showing the culvert header installed in the ditch.

As shown in FIG. 2, the header is installed in a substantially vertical position with the adjustable inlet device 11 on the upstream side of the head-wall 10, and with the thimble 13 inserted in the upstream end of the culvert 20. Conventionally, the wing-walls 12 are positioned either side of the head-wall 10, with the free ends of the wing-walls upstream of the head-wall 10. Aggregate 21 is placed on top of the culvert 20 and behind the header, and a driveway 30 is constructed on the aggregate 21.

During a heavy rainstorm, such as a thunder shower, rapid flow of water through the ditch 25 is impeded by the header holding back water 40 upstream of the head-wall 10, which is released by the adjustable inlet control device 11. The thimble 13 is of the same size and shape as the culvert, having an outside circumference the same as the inside circumference of the culvert, and is shown in greater detail in FIG. 6 hereof.

Figure 3:
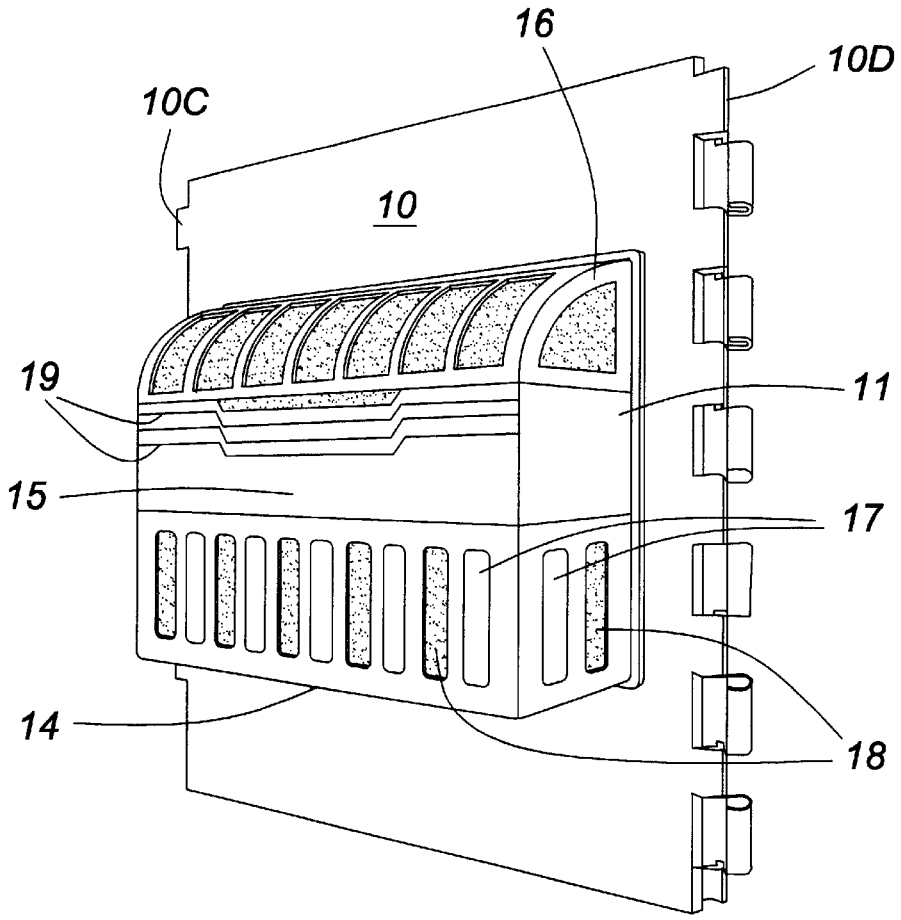
FIG. 3 is a perspective of the adjustable inlet control device.
Figure 4:
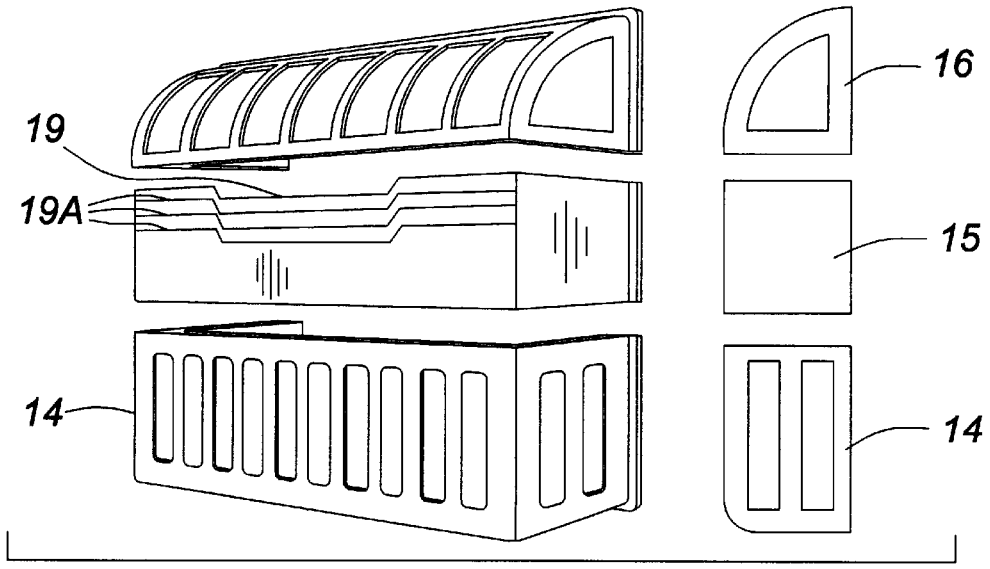
FIG. 4 is an exploded view of the components of the control device of FIG. 3.

FIG. 3 is a perspective view of the adjustable inlet control device 11 mounted on the head-wall 10. FIG. 4 is an exploded view of the inlet control device 11. The control device 11 consists of a base section 14, an upper wall section 15, and a cover section 16. The base section 14 is provided with openings 17 and knockouts 18, which may be removed in sufficient number so as to permit the passage of volumes of water that are less than, or at maximum not in excess of the flow of water during the average occasion rainfall experienced in the area of installation. Flows greater than this such as are encountered during a storm event are restrained and slowly released at a moderate flow rate over an extended period of time. The flow moderation, and slow release of the large volumes of water substantially reduces the risk of washout of culverts, and the risk of overloading downstream flow channels, and consequent damage to the drainage system, and risk of pollution from such damage.

The upper wall section 15 of the inlet device 11 is designed so that it can be installed and adjusted to various heights so that it will detain volumes of water upstream of the header 10, to a level that is relevant to the topography of the installation. In order to accomplish this, the top edge 19 of the upper wall section 15 is designed to form a weir. Recessed grooves 19A may be embossed below the rim 19 of the upper wall section 15, to provide guides to assist in and facilitate cutting or removal of the rim 19 of the upper wall section 15 so as to further refine the height of the weir section.

The cover 16 is an optional section designed to prevent the flow of debris or floatables into the inlet device 11 and to the culvert 20. The width and length of the inlet device 11 are so designed that the cross-sectional area of the inlet device is approximately equivalent to the area of the largest culvert or conduit into which the spillover water will be released in order to provide unimpeded flow of water in extreme storm events.

Figure 5:
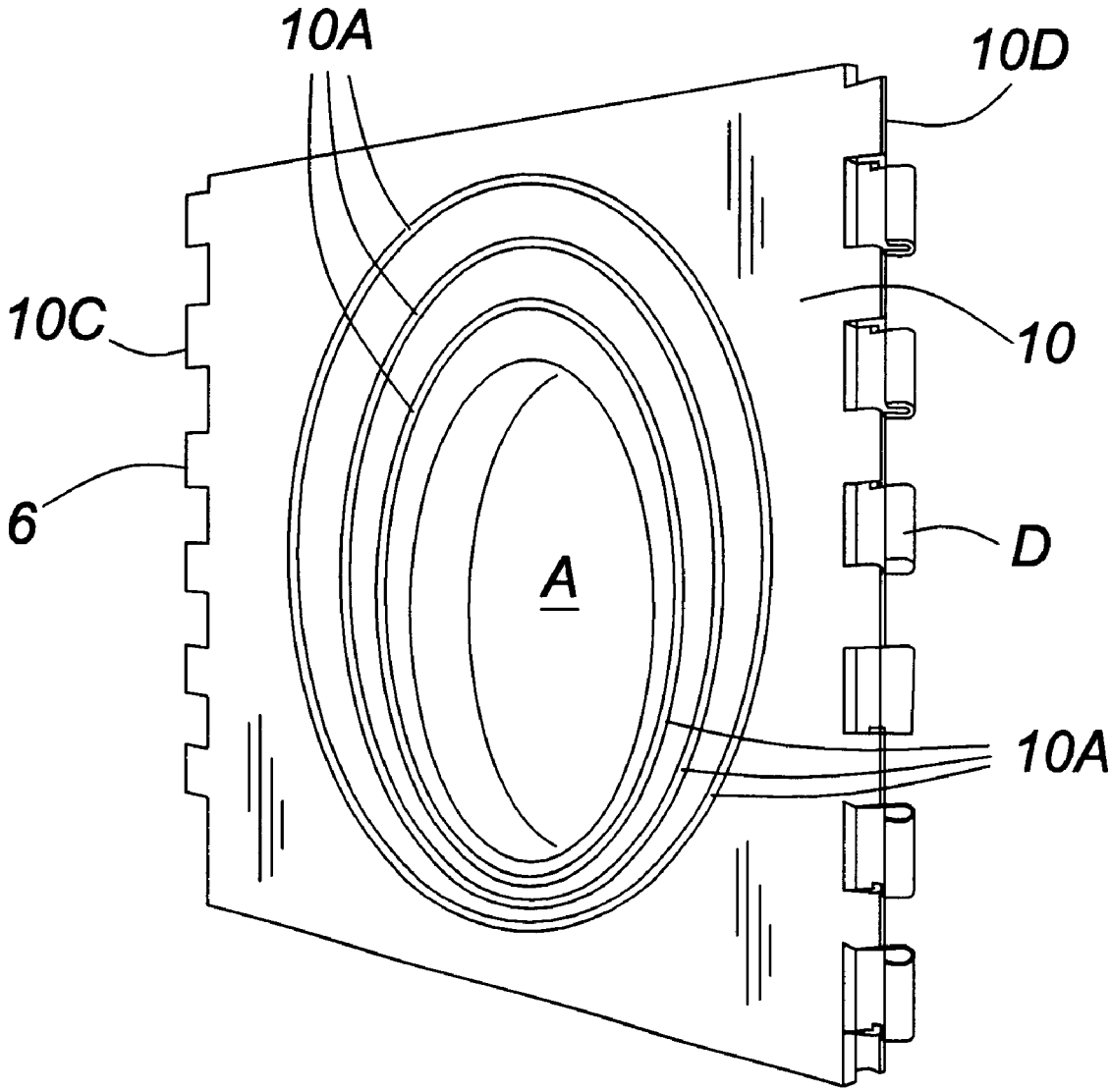
FIG. 5 is a perspective view of the head-wall or flat plate of the header.
Figure 6:
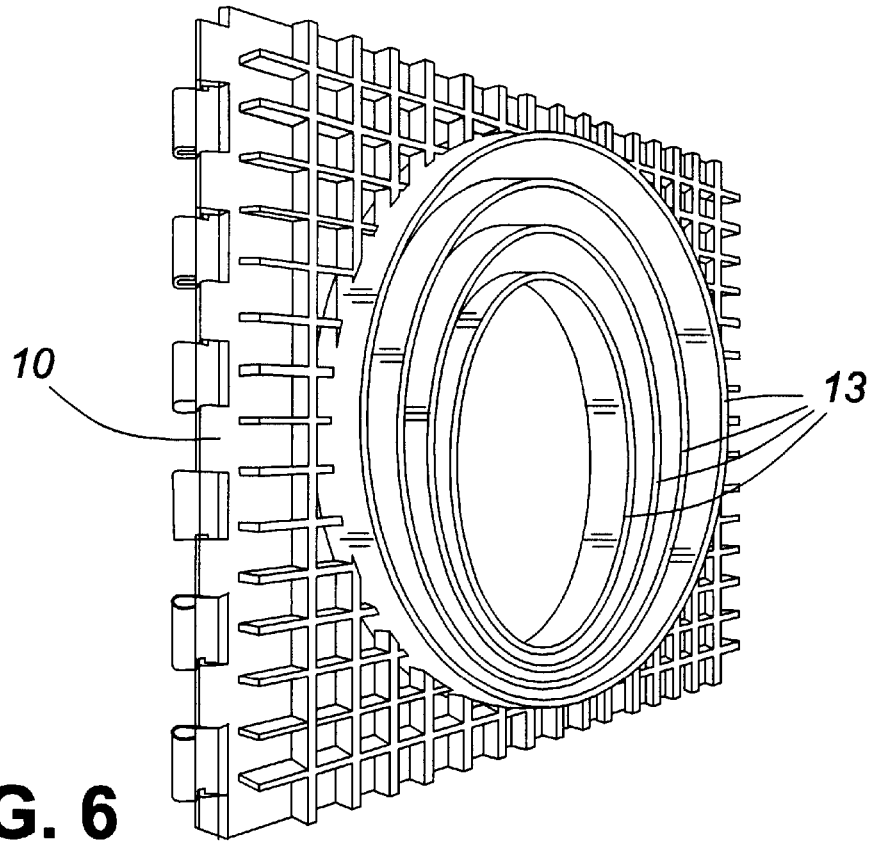
FIG. 6 is a perspective view of the downstream side of the plate of Figure.
Figure 7:
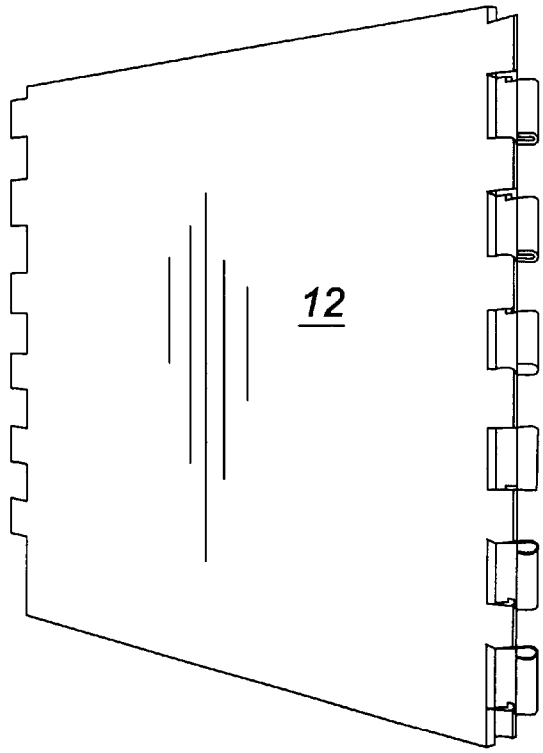
FIG. 7 is a perspective of a wing-wall attachable to the head-wall

Referring to FIGS. 5 and 6, the head-wall 10 is shown in upstream and downstream views respectively. In FIG. 6 a plurality of thimbles 13 are shown, which may be used for connection to a plurality of different sizes of culvert. These thimbles 13 are arranged eccentrically so that the thimble selected will be as low on the head-wall 10 as possible. Indentations 10A molded into or scribed on the upstream face of the head-wall opposite the thimbles are provided as guides to assist in cutting out portions of the head-wall 10 in order to provide the opening required for the culvert, by removal of thimbles 13 which are smaller than that required for the installation of the correct size of culvert header thimble 13 into the culvert 20. Reinforcing ribs may also be molded into the downstream side of the head-wall 10. The side walls may be similarly strengthened, as required.

The vertical edges 10C and 10D are designed with tabs C and D for interlocking the head-wall 10 to the sidewalls 12 by inserting a pipe or re-bar through the tabs of the vertical edges of the adjoining walls. The top edge and lower edge of the head-wall, may be formed so as to provide purchase for construction materials that may be installed to retain grade above or below the edge of the walls. The preferred material for forming the control header of the invention is polyvinyl chloride (PVC) although other materials may be selected for specific applications or locations. Strength requirements are not high since the material backfilled against the downstream side of the header resists the forces of the water against the upstream side of the header.

Persons understanding the invention will appreciate that variations in the construction of the header may be made that will fall within the scope of the appended claims.

I claim:

1. A storm-water header for connection to a culvert or conduit to moderate the flow of storm-water through the culvert comprising, a head-wall having a thimble on the downstream side thereof, an adjustable inlet control device on the upstream side of the head-wall, said head-wall being adapted to be vertically mounted in a ditch or water course with the thimble received in said culvert, weir means in said control device for retaining water to a depth of the position of the weir, and having a base section provided with openings to permit the flow of a reduced volume of water through said control device, whereby heavy flows of storm-water pass over said weir, and light flows of rain fall flow through said openings in said base section.

2. A storm-water header as claimed in claim 1, where said head-wall has a plurality of thimbles on said downstream side, said plurality being eccentrically formed with the spaces closest at the bottom of said header, said thimbles being adapted for removal to provide an opening to match the size of said culvert.

3. A storm-water header as claimed in claim 2, wherein circular indentations are formed in the upstream side of the head-wall corresponding to the interior surfaces of the thimbles to provide guides to assist in cutting out portions of the head-wall to match a thimble to a culvert into which said thimble is to be inserted.

4. A storm-water header as claimed in claim 1, in which said head-wall is provided with means for attaching wing-walls to the sides of said head-wall.

5. A storm-water header as claimed in claim 4, in which said means comprises tabs on the sides of the head-walls and the wing-walls adapted to receive connecting means to secure the tabs of the wing-walls to the tabs of the head-wall.

6. The storm-water header of claim 5, in which said connecting means comprises a re-bar.

* * * * *